United States Patent [19]

Mowry, Jr.

[11] Patent Number: 4,681,348

[45] Date of Patent: Jul. 21, 1987

[54] FINANCIAL DOCUMENT PROTECTION

[75] Inventor: William H. Mowry, Jr., Ionia, N.Y.

[73] Assignee: The Standard Register Co., Dayton, Ohio

[21] Appl. No.: 739,848

[22] Filed: May 31, 1985

[51] Int. Cl.[4] ..... B42D 15/00; G09F 3/03

[52] U.S. Cl. ..... 283/58; 283/72; 283/57

[58] Field of Search ..... 283/57, 58, 59, 70, 283/72, 85, 94, 95; 428/915

[56] References Cited

U.S. PATENT DOCUMENTS

| | | | |
|---|---|---|---|
| 970,341 | 9/1910 | Kucera | 283/58 X |
| 1,144,742 | 6/1915 | Todd et al. | 283/72 |
| 1,145,447 | 7/1915 | Todd et al. | 283/58 |
| 1,431,038 | 10/1922 | Prokopovitsh | 283/58 X |
| 1,564,724 | 12/1925 | Todd et al. | 283/94 |
| 2,065,605 | 12/1936 | Moore | 283/94 |
| 2,804,821 | 9/1957 | Misuraca | 283/58 |
| 3,276,791 | 10/1966 | Plotkin | 283/58 |

FOREIGN PATENT DOCUMENTS

| | | | |
|---|---|---|---|
| 680924 | 2/1964 | Canada | 283/58 |
| 469015 | 7/1914 | France | 283/58 |
| 692505 | 11/1930 | France | 283/58 |
| 1434907 | 5/1976 | United Kingdom | 283/85 |

OTHER PUBLICATIONS

Tyler Corporation Cheque.

*Primary Examiner*—Howard N. Goldberg
*Assistant Examiner*—Taylor J. Ross
*Attorney, Agent, or Firm*—Killworth, Gottman, Hagan & Schaeff

[57] ABSTRACT

A document protected against alteration comprises a sheet of paper having, on its face, an area in which numerals representing a sum of money to be paid on the document are printed. The area has a left end and a right end, and the entire length of the area, from the left end to the right end, is filled with printing so that unauthorized insertions cannot be made in the area.

6 Claims, 4 Drawing Figures

FINANCIAL DOCUMENT PROTECTION

BACKGROUND OF THE INVENTION

Many methods are known to protect documents from alteration; however, none of these methods is completely satisfactory, and improvements are always needed. The present invention provides such improvements in document protection.

DESCRIPTION OF THE INVENTION

Figure 1:
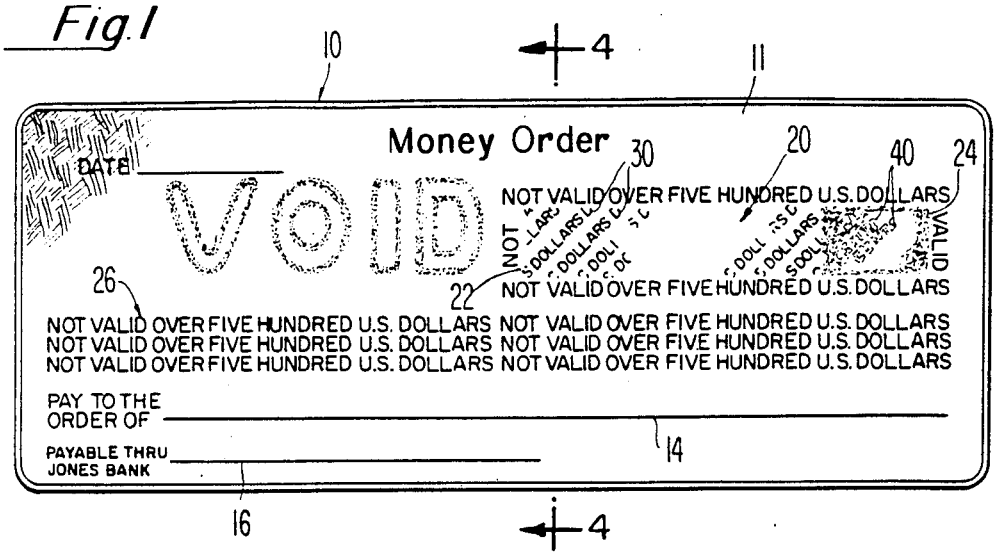
FIG. 1 is a plan view of a document embodying the invention.
Figure 2:
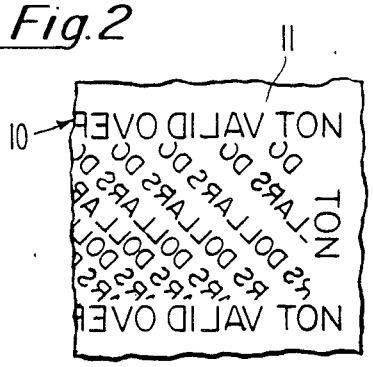
FIG. 2 is a plan view of a portion of the document of FIG. 1.

Referring to FIG. 1, a document 10, for example, a travelers check, money order, or the like, comprises a sheet of paper 11 which bears the usual printed material. For example, a money order might include a line 12 for date, a line 14 for the payee's name, and a line 16 for the payor's signature. The document also has an area 20, on which the numbers for the amount to be paid appear. This area 20 is also surrounded by printing "not valid over 500 dollars", for example. There is also an area 26 of several lines which extend across the document and carry a message also limiting the maximum amount to be paid on the document. The exact amount to be paid may be typed in this area using words and numbers.

In addition, the background of the money order 10 may carry a pattern in which the word "VOID" is hidden by any suitable method, as is well known in the art. Also, according to the invention, for added protection, the word "dollars" is printed as a positive in diagonal, variably spaced rows 30 in the area 20 in the region where the dollars would appear, and the word "cents" is printed in negative form in diagonal, variably spaced rows 40 in the cents region of the area 20, as shown in FIG. 1.

As added protection, the rear of the sheet 11 is printed with the reverse image of the area 20 and the "dollars" and "cents" diagonal rows 30 and 40 and the dollar-limiting printing that encircles space 20.

Figure 3:
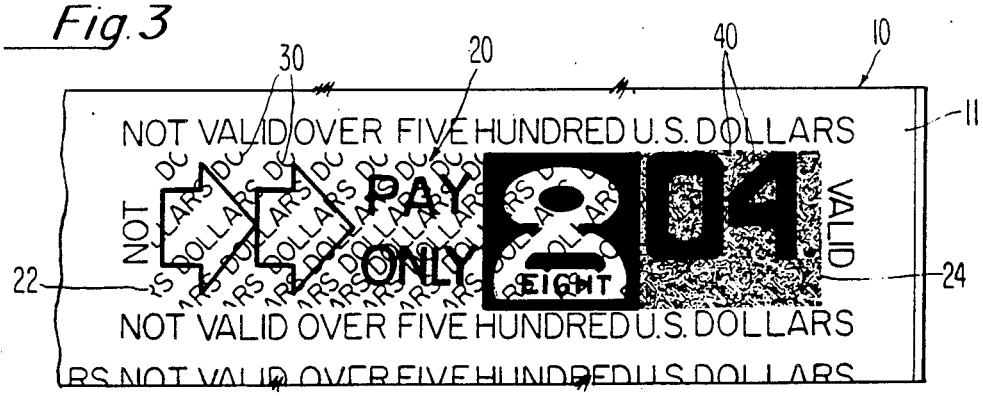
FIG. 3 is a plan view of a portion of a modification of a document embodying the invention.

According to the invention, in using the check or money order 10 of FIG. 1 and as illustrated in FIG. 3, the amount-receiving area 20 is filled from one end 22 to the opposite end 24 with print produced by a printer over the "dollars" and "cents" rows 30 and 40 so that unauthorized insertions cannot be readily made and the rows duplicated. If the actual dollar amount does not fill the length of the space 20, then words such as "PAY ONLY" and arrows or other symbols fill the remainder of the space, as illustrated in FIG. 3.

Further, according to the invention, the areas 20 and 26 of the document 10 are coated with layers 50 and 52 of self-contained pressure-sensitive image-forming chemicals in the areas 20 and 26, respectively. The layers 50 and 52 include a first free chemical substance and a second chemical substance which is held immobilized in frangible capsules. The second chemical substance is released from the capsules when pressure is applied to the document by a printing device, and the released second chemical substance reacts with the first chemical substance to form an "ink" which forms the desired message on the document. The first chemical may be a phenolic resin, and the encapsulated second chemical may be crystal violet lactone. The layers 50 may be made up of any well known materials such as those used in CLT paper made by Burroughs Corporation, or of the types described in U.S. Pat. No. 4,010,292 of Shackle et al and U.S. Pat. No. 4,197,346 of Stevens, which are incorporated herein by reference.

The layer 50 is formed on the sheet 11 by any suitable coating process.

In using the document 10, an impact printer is used to print the desired numerals and characters in the spaces 20 and 26, and the pressure of the printer on the encapsulated imaging materials in the layer 50 and 52 releases the encapsulated chemicals which react with the first chemical to form the printed numerals and characters in the spaces 20 and 26. Any attempt at alteration will release more of the encapsulated chemical which will react with the first chemical and smudge the authorized printed message or will be otherwise immediately visible, and a holder of the document will be warned.

Figure 4:
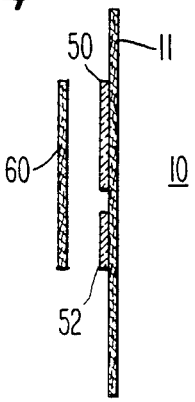
FIG. 4 is a sectional view along the lines 4—4 in FIG. 1, with a print ribbon associated with the document.

According to the invention, in using the document 10 and as illustrated in FIG. 4, a printing ribbon 60 is used in the printing process to add the pigment and/or dyes from the ribbon to the chemically formed printing "ink" to thus provide a unique color for the printed numerals. Modification of the uniquely colored printed numerals would be extremely difficult to accomplish without the alteration being obvious. To further enhance the process, the ribbon may be provided with an ink color which blends with the pigment of the layers 50 and 52 to provide a visible ink of exotic or unusual hue which would be difficult to alter or duplicate. Alternatively, the ribbon may contain the second chemical substance contained in layers 50 and 52 or another similar chemical.

What is claimed is:

1. A financial document protected against alteration, comprising:

a substrate, a first area, extending across a portion of the surface of said substrate, for indicia specifying the amount of said financial document, said first area having at least one line of indicia indicating a maximum amount, and a second area on said substrate for indicia specifying the amount of said financial document, said second area having associated therewith indicia specifying the maximum amount of said financial document and further including a plurality of diagonal variable spaced lines of indicia which indicate currency.

2. A financial document protected against alteration, comprising:

a substrate, a first area, extending across a portion of the surface of said subtrate, having at least one line of indicia including a maximum amount, and a second area on said substrate for negative indicia specifying the amount of said financial document, said second area having diagonal variable speed lines of indicia which indicate currency.

3. The document of claim 2 wherein the currency is specified in positive indicia.

4. A document protected against alteration comprising a substrate, an area extending substantially across the surface of said substrate having at least one line of indicia indicating a maximum amount, and a second area on said substrate bounded by indicia indicating the maximum amount for which a valid entry can be made, said second area having diagonal variable spaced lines of indicia indicating currency.

5. The document defined in claim 4 wherein the currency is "cents".

6. The document defined in claim 4 wherein the currency is "dollars".

* * * * *

UNITED STATES PATENT AND TRADEMARK OFFICE

CERTIFICATE OF CORRECTION

PATENT NO. : 4,681,348

DATED : July 21, 1987

INVENTOR(S) : William H. Mowry, Jr.

It is certified that error appears in the above-identified patent and that said Letters Patent is hereby corrected as shown below:

Claim 2, line 63, Column 2, "speed" should be --spaced--.

Signed and Sealed this

Twenty-second Day of December, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,681,348

DATED : July 21, 1987

INVENTOR(S) : William H. Mowry, Jr.

It is certified that error appears in the above-identified patent and that said Letters Patent is hereby corrected as shown below:

Claim 2, line 60, column 2, "including" should read -- indicating --.

Signed and Sealed this

Fifteenth Day of March, 1988

*Attest:*

*Attesting Officer*

DONALD J. QUIGG

*Commissioner of Patents and Trademarks*